United States Patent [19]

Wood et al.

[11] 4,402,551

[45] Sep. 6, 1983

[54] METHOD AND APPARATUS TO COMPLETE HORIZONTAL DRAIN HOLES

[76] Inventors: Edward T. Wood, 3415 Fawn Creek; Robert Snyder, 2010 Grove Lake Dr., both of Kingwood, Tex. 77339; William C. Larson, 8301 Ewing Rd., Bloomington, Minn. 55431; Donald W. Dareing, 13914 Jaycreek Ct., Houston, Tex. 77070

[21] Appl. No.: 276,609

[22] Filed: Sep. 10, 1981

[51] Int. Cl.[3] ..... E21B 43/28

[52] U.S. Cl. ..... 299/5; 166/50; 166/117.5; 166/285; 175/61

[58] Field of Search ..... 299/4, 5, 2; 166/50, 166/117.5, 117.6, 285; 175/45, 61

[56] References Cited

U.S. PATENT DOCUMENTS

| | | | |
|---|---|---|---|
| 2,452,920 | 11/1948 | Gilbert | 166/50 X |
| 2,492,795 | 12/1949 | Goble et al. | 175/45 |
| 2,726,847 | 12/1955 | McCune et al. | 175/61 |
| 2,804,926 | 9/1957 | Zublin | 166/50 |
| 2,858,107 | 10/1958 | Colmerauer | 166/50 X |

OTHER PUBLICATIONS

Holbert "Technical Considerations in Drainhole Drilling" ASME Publication 81-PET-14, Jan. 1981.

Maurer Engineering Inc. "Evaluation of Branch and Horizontal Boreholes for in situ Leach Mining" Jul. 1980, Pub. Jan. 1981, Coflexip Pipe Brochure.

*Primary Examiner*—Ernest R. Purser

*Attorney, Agent, or Firm*—Thomas Zack; Donald Gardiner

[57] ABSTRACT

A method and the necessary equipment to form horizontal cased and perforated drainholes for an underground, in situ leach mining operation. After a vertical hole has been formed and cased in the earth, horizontal drainholes are to be drilled from below its casing. The depth and thickness of the ore body which is to be recovered is determined. Following this, the proper whipstock orientation is computed and the horizontal drainhole is whipstocked and drilled from above the ore bed into it. A flexible casing, such as Coflexip pipe, is used to case the drainholes. Perforations or slots are provided for in these casings before they are put in the earth. A special retrievable cement plug, basket, and one-way valve are used to control and direct the flow of cement to the volume between the outside of the juncture at the casings.

12 Claims, 3 Drawing Figures

6
15
3
3
21
17
19
17
1
15
Fiberglass
Coflexip Pipe
3
5
19 foot radius
3
11
33
23
11
13
7
9
37
3
33
23

METHOD AND APPARATUS TO COMPLETE HORIZONTAL DRAIN HOLES

BACKGROUND OF THE INVENTION

1. Field of the Invention

A method and apparatus to form horizontal drainholes for in situ leach mining.

2. Description of the Prior Art

The prior art discloses several methods of forming drain wells from a main generally vertical hole. One example is the U.S. Pat. No. 4,222,611 to W. C. Larson et al wherein branch wells are whipstocked from a main vertical hole at an angle from about 2 degrees to 60 degrees. In other references, drainholes have been formed approximately 90 degrees from the vertical (e.g. U.S. Pat. No. 2,171,416 to R. E. Lee and U.S. Pat. No. 4,249,777 to W. C. Larson et al). Most of those inventions which utilize horizontal drainhole drilling have been used to improve the productivity of oil or gas wells. However, these horizontal holes have, to our knowledge, never been cased and perforated as would be required in an effective deep lying in situ leach mining operation. In Pat. No. 4,249,777 to our coinventor, W. C. Larson, horizontal branch wells were disclosed for an in situ leach mining method. Therein the drainhole drilling technique employs a flexible U-joint spiral reamer and a whipstock which is used to form the horizontal branches. The branches are also disclosed as being either cased or uncased. What is not disclosed or taught is the specific in situ leach mining method used to form horizontal drainholes in which a small radius hole (about 19 feet in the example disclosed) joins the horizontal hole to the deep generally vertical main hole. The present invention thus allow deep lying (in excess of 2,000 feet) thin beds, such as those bearing uranium ore, to be economically mined by the in situ leach mining method. The ASME publication 81-Pet-14 entitled "Technical Considerations in Drainhole Drilling," by D. R. Holbert provides excellent background material on drainholes.

The principles underlying this invention and several related inventions can be found in the final contract (JO199113) report entitled "Evaluation of Branch and Horizontal Boreholes for In Situ Leach Mining" prepared by Maurer Engineering Inc. of Houston, Texas, for the U.S. Bureau of Mines and first released for publication in January 1981.

The present invention seeks to overcome the deficiencies of the prior art by providing a novel method and the apparatus to practice that method which is used to form generally horizontal drainholes that are cased and perforated. It further seeks to use these drainholes with in situ mining methods and a casing which is perforated before being placed in the horizontal branch well.

SUMMARY OF THE INVENTION

Our invention is a method and apparatus employed in the in situ leach mining art which is used to form generally horizontal drainholes from a main generally vertical hole. These drainholes are cased, cemented, and have their respective casings perforated. Before actually drilling the horizontal holes, a vertical rathole is drilled into the ore body to determine its depth and thickness. Using this data and the deviation and direction of the rathole, the whipstock orientation can be computed. Next, a whipstock of a special design is run in the rathole to the appropriate depth and set by a setting tool. Thereafter a special drill is used to drill the horizontal hole and the drilling is monitored to insure it remains horizontal. Next a flexible super strong Coflexip pipe casing is placed in the small radius hole in sections that are joined together. The horizontal casings are selectively perforated or slotted in the production process. Cement is introduced where the curved hole casing section joins the horizontal casing section. A cement basket retains the cement and prevents its movement forward thereof while a special retrievable plug allows the cement to be introduced in the volume desired.

The primary object of this invention is an improved method and apparatus to form horizontal drainholes useable with in situ leach mining techniques.

DESCRIPTION OF THE PREFERRED EMBODIMENT

The invention disclosed herein relates to drilling short radius horizontal holes from below vertical casings. This type of invention would as a consequence find its major applicability in leach mining where the in situ ore bed is relatively thin (about 30 feet or less) and the depth of the bed deep, i.e., over 2,000 feet from the surface. Examples of minerals that could be recovered include, without limitation, uranium, trona, and potash. Current state-of-the-art techniques limit the smallest radius of curvature for surface drilling to 19 feet—30 feet of linear drilling or 3 degrees per foot—to produce a horizontal drainhole at depths greater than 2,000 feet. Future refinements may decrease this radial distance, however, in the preferred embodiment disclosed this 19 foot distance is used.

Figure 1:
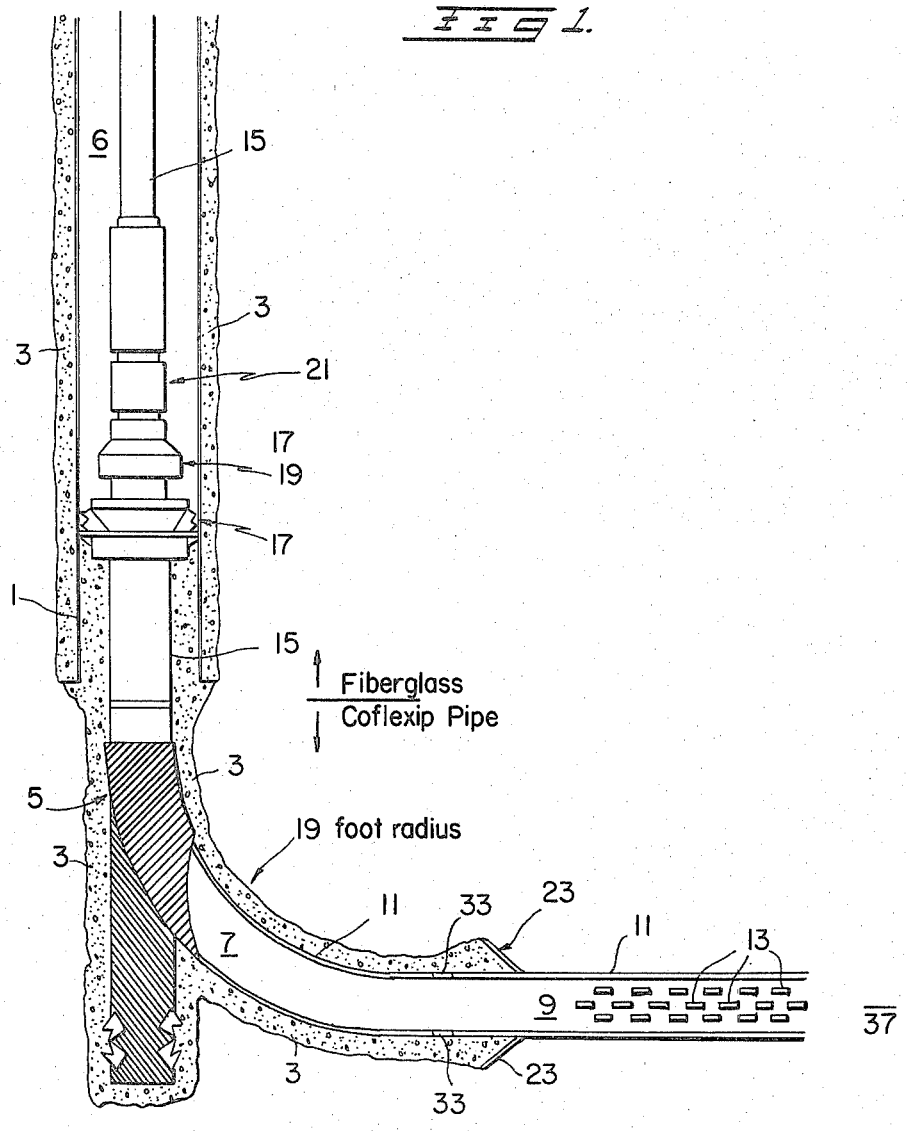
FIG. 1 illustrates a schematic diagram of how the preferred embodiment of our invention would appear in situ.

The FIG. 1 schematic shows the lower end of the vertical steel casing 1 which has been cemented (3) in place along its length and also along the whipstock sheath 5. This is accomplished by first drilling the main vertical hole 6, and then inserting and cementing the steel casing. Horizontal drainholes are to be drilled from below this casing. This casing is set and cemented in place about 15 feet above the ore body whose material is to be recovered. Once this is done, a small (about $4\frac{3}{4}$ inches dia.) rathole is drilled vertically through the ore. Electric logs are then used to determine the depth and thickness of the ore bed, and a single shot survey is used to determine the deviation—from true vertical—and actual direction of the rathole. Those familiar with standard oil field technology are well aware of the terms electric logs and single shot surveys. Electric logs refer to downhole instrumentation used to determine types of formations. Single shot surveys are borehole surveys made with a single shot instrument used to determine borehole inclination from true vertical and global orientation. The directional data for the rathole combined with the bed thickness data can be used to compute the proper whipstock location and orientation. The whipstock is located in the rathole above the ore body to allow sufficient vertical distance to build the drainhole angle and to penetrate the ore body horizontally.

Following this computation, a special whipstock on the lower end of drill pipe is run to the appropriate depth in the rathole. The object is to put the lower end of the whipstock (i.e., where it joins the horizontal drainhole) so that it is in the middepth region of the ore body. Special angle building tools are used (manufactured by Drainhole Inc. of Littleton, Colo.) to drill the minimum 19 foot radius section 7 of the whipstock hole. This drilling assembly is guided into the proper direction by the whipstock. Once it is believed the angle is turned and the hole is essentially horizontal, a special, such as the type commonly used in a standard oil field, 120 degree angle magnetic single shot unit is pumped around the turn to verify that a horizontal hole has been achieved. Longer radii curvatures could also be drilled, depending on the thinness of the ore bodies, and such configurations would simplify subsequent completion procedures.

The horizontal section 9 of the hole is drilled with a stabilized drill assembly (not shown). This assembly has a stabilizer centralized of the drill pipe near the bit to help maintain a straight hole direction. Every 50 to 80 feet a directional survey is transported down this section, and then retrieved, to verify the direction of the horizontal hole. This process of drilling and surveying is repeated until the horizontal drainhole is completed. This hole would typically be a 4 inch diameter hole.

The next step is to case the horizontal hole. The whipstock sheath 5 is left in place in hole section 7 to act as a guide for the casing to be inserted in the horizontal hole and the whipstock section. Due to the great stresses placed, caused by the short bending radius and deep depth, conventional steel or fiberglass casing cannot be used. What we have selected to do this job is a pipe section which is made from high strength materials that can resist collapse and survive exposure to leachants. Our preferred embodiment uses one of the few known pipes that can fit these performance specifications. This is Coflexip pipe made by Coflexip and Services, Inc., of Houston, Texas. These pipes have been used for offshore pipelines, control lines or subsea blowout preventers, and for high pressure lines for acidizing oil wells. To our knowledge they have not been used heretofore for any type of in situ leach mining operation.

Coflexip pipes are made of several concentric layered main components. These include: an inner thermoplastic liner next to a steel carcass of interlocking spiralled Z section; then a continuous armoring steel two layered componenet over the Z section, and an outer thermoplastic sheath. The two thermoplastic sections are leakproof and corrosion resistant and function to isolate and protect the steel layers from corrosion, abrasion, and harsh chemicals. The two adjacent layers of continuous armoring steel provide tensile and impact strength. And the steel carcass of interlocking spiralled Z-section withstands high pressure, provides high fatigue strength, and preserves the pipe's roundness even when subjected to a short bending radius. Typical of the properties for a 4 inch O.D. (2 inch I.D.) 16 lb/ft Coflexip pipe are 7,500 psi internal test pressure when bent around a curve with a minimum radius of 1½ feet. These casings may be of sufficient length to complete the full 19 foot radius section and the horizontal section.

Figure 2:
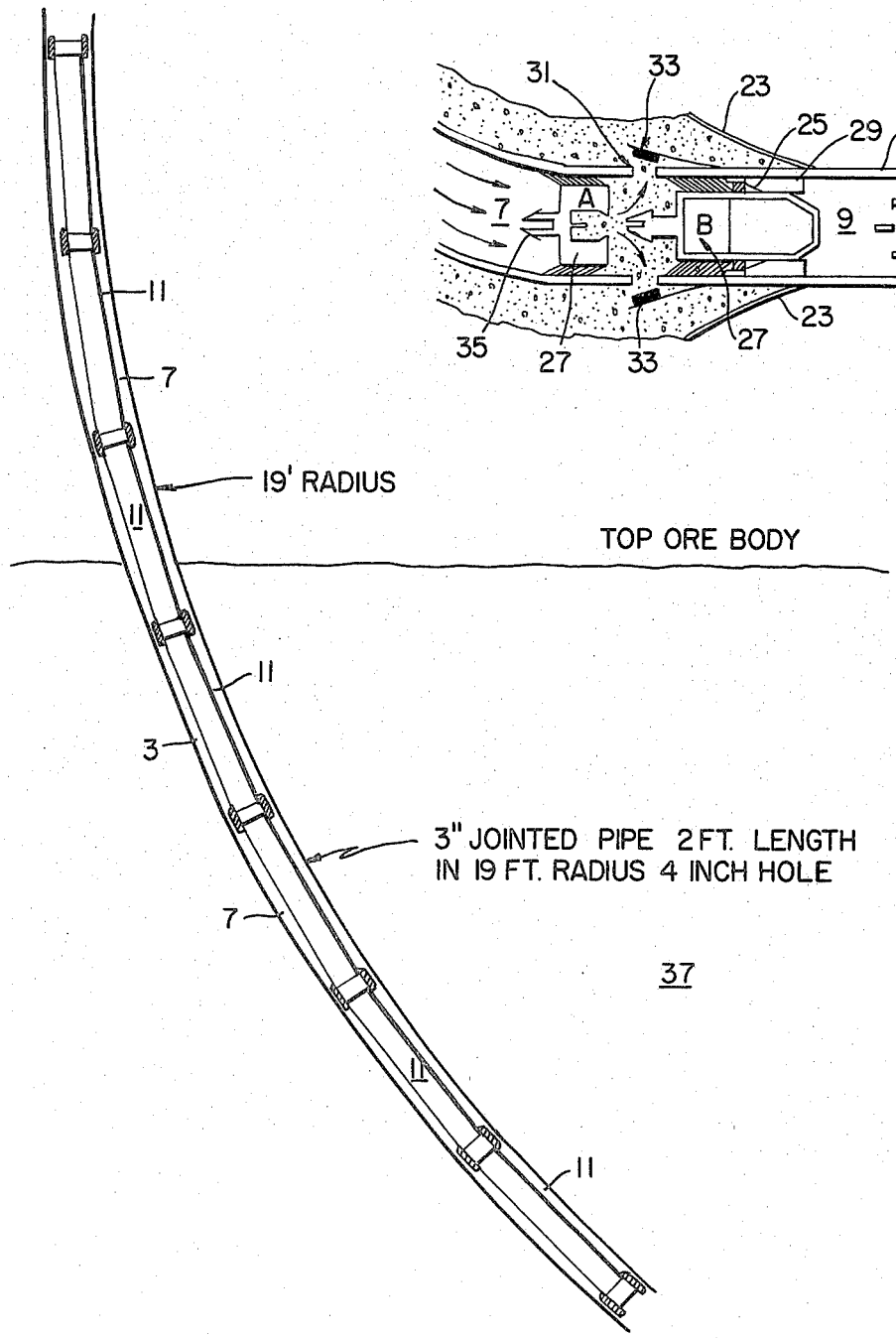
FIG. 2 shows how short sections of pipe forming the short radius of FIG. 1 could be joined together as an alternate to using the preferred Coflexip pipe.

An alternate embodiment of pipe casing is shown in FIG. 2. Pipes 11 could be used in joined sections (2 feet in length) to form the casing around the 90 degree turn (section 7 of FIG. 1) and throughout the horizontal hole section 9 after the turn. During casing production, slots and/or perforations 13 maybe put in the horizontal sections of this flexible casing or personnel may slot or perforate these casings on site, prior to insertion in the drill hole.

Again referring to FIG. 1, there is shown several other conventional members. There is conventional fiberglass pipe 15 in the vertical interval between the top of the Coflexip pipe and the liner hanger 17 as well as from the liner hanger 17 to the earth's surface. In addition a safety left hand connection 19 is depicted and there is a pump 21 to recover the leachant and recoverable ore material, if the well is a production well as shown in FIG. 1. This connection is used to retrieve the fiberglass casing and pump apparatus.

Figure 3:
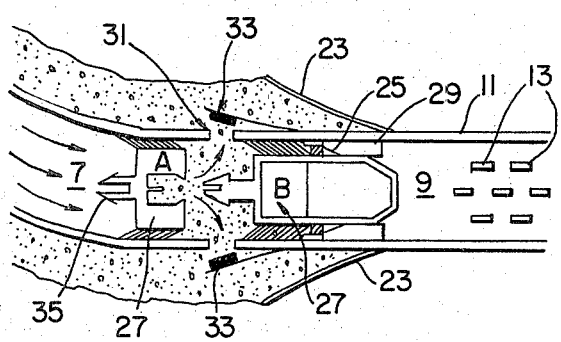
FIG. 3 depicts in detail the special cement collar used to form the preferred embodiment.

Special cementing procedures are used to cement the casings. These require the use of a cement collar such as that shown in FIG. 3 wherein the arrows represent the flow of cement in the filling process. This collar is used with the cement basket 23 (see FIGS. 1 and 3) to restrict and direct the flow of cement to the desired portions of the volume between the various casings and holes. Essentially the collar comprises a shoulder assembly 25, a wireline retrievable cement plug 27, and a pipe section 29. The plug assembly is made up of two plugs (A and B) as shown in FIG. 3. Plug B functions to keep cement from entering the horizontal portion of the perforated casing. And plug A separates cement from drilling mud and is pumped down to displace cement out of the center of the pipe into the annular space between pipe and borehole wall. The pipe section 29 of the collar is a short (two foot) section of corrosion-resistant pipe with an internal upset or shoulder 25 designed to fit retainer plug B. Flowing cement exits via opened port 31 and the two one-way check valves 33 to enter the volume to be filled. The cement baskets 23 surrounded the exterior of the horizontal casing a short distance back from there it joins the whipstock casing 11 to prevent cement from flowing forward along the horizontal casing towards its production end. The finished cementing process would appear as in FIG. 1 after the plug 27 is retrieved to the surface; the cementing ports 33 closed by the hydrostatic pressure difference between the outside and inside casing fluid pressures, and the liner hanger set with cement. Cement is removed from above the hanger by releasing tubing from the safety connector 19 and reversing out the flow of cement.

Plug 27 is designed so that it may latch onto the preceding plug. It also has a fishing hook type neck 35 exposed for wireline retrieval. A fishing grapple and the knuckle-jointed weights (neither shown) are used to retrieve the plugs. The retrievable cementing plug system eliminates the need to drill out within the Coflexip pipe, or other suitable material and prevent damage to the pipe interior wall. As a safety factor, the plugs are constructed of a material that is soluble in acid or leach fluid. This would allow the plugs to be dissolved should wireline retrieval fail.

Now the well is ready for the injection of the leach fluid into the ore body 37. Or the well may be a recovery or producer well such as that shown in FIG. 1 employing the pump 21 to move material to the surface. Many configurations can be used to space the placement of the well wherein each recovery/injector well employs the method and apparatus of our invention as exemplified by the FIG. 1 embodiment. The previously mentioned U.S. Pat. No. 4,222,611 discloses but a few of the many types of well patterns which we could employ. Neither the specific subject matter disclosed herein nor any of the patterns disclosed in the mentioned patent should be used to limit the scope and extent of our invention which is to be measured only by the claims which follow.

We claim:

1. A method for forming horizontal drainholes for use with in situ leach mining comprising the steps of:

a. forming and casing a generally vertical main hole in the earth;

b. determining the proper whipstock orientation from the bottom of the casing in the main hole which will allow the ore body whose materials are to be recovered to be intersected therefrom in a generally horizontal plane;

c. drilling out sufficient earth and inserting a whipstock guide therein based upon the orientation determined in step b;

d. drilling a radial hole from below the vertical casing and therefrom a horizontal hole using the whipstock guide of step c;

e. casing the radial hole and horizontal hole formed in step d by using a plurality of flexible joined sections of high strength piping, said horizontal hole's casing have holes therein; and f. cementing the volume around the casing of step e, surrounding the juncture of the radial hole and horizontal hole.

2. The method of claim 1 wherein cementing step f employs both a retrievable cement plug mounted in the horizontal casing near where it joins the casing of the radial casing and a cement basket surrounding the horizontal casing near the same location.

3. The method of claim 1 wherein step b comprises:

the drilling of a generally vertical hole from the main hole into the ore body to determine the depth and thickness thereof; and computing the orientation of the whipstock using, at least in part, this data.

4. The method of claim 3 wherein the deviation of the hole drilled in step b from the vertical as well as the direction of this hole are also used in determining the whipstock orientation.

5. The method of claim 1 wherein:

the vertical main hole of step a is drilled to a depth of over 2,000 feet; and the radius of curvatures for the radial hole drilled in step d is approximately 19 feet.

6. A well system for use with an in situ leach mining recovery process comprising:

a main generally vertical deep hole extending over 1,000 feet into the earth, said hole having a casing therein extending substantially its total length;

a whipstock hole section located near the bottom of said main hole casing and extending outwardly therefrom and terminating in a horizontal direction with respect to the main hole casing, said hole section having a series of high strength interconnected flexible casing members coupled together therein;

a horizontal hole extending from the end of the whipstock hole section remote from the main hole, said horizontal hole having a series of high strength interconnected flexible casing members with preformed holes through at least some of said casing members, said horizontal and whipstock casings being joined together whereby a leachant solution may pass through the casings at its holes in the horizontal casing; and means for joining the whipstock casing to the horizontal casing, said means allowing cement to enter the volume between the outside of the casings and the surrounding holes without entering the horizontal casing.

7. The well of claim 6 said means for joining also comprising a cement collar assembly to join the whipstock casing to the horizontal casing members, said assembly having a surface retrievable plug therein which can be removed after the desired volume between casings is filled with cement.

8. The well of claim 7 wherein said collar assembly has ports which allow cement to enter the volume between the casing and hole to be filled, said ports being closeable by a pressure activated check valve.

9. The well of claim 6 wherein the casing system members used in the whipstock and horizontal hole sections are Coflexip pipe.

10. The well of claim 6 wherein the radius of curvature of the whipstock section is about 19 feet thereby allowing ore bodies less than 40 feet thick to be intersected by the horizontal branch hole in a generally parallel direction.

11. The well of claim 6 wherein said means for joining allows cement to enter and be located between the main hole casing and the whipstock casing and their respective adjacent hole sections, said cement extending part way up and around the horizontal hole casing where it joins the whipstock casing, and a cement restriction member extending around the outside of the horizontal casing to prevent its entering the ore body production zone.

12. The well of claim 6 wherein the casing system has casing members made of sections of pipe, two feet or less in length joined together by couplings to the next casing member.

* * * * *